US007406975B1

(12) United States Patent
Carrier, Jr.

(10) Patent No.: US 7,406,975 B1
(45) Date of Patent: Aug. 5, 2008

(54) MULTI-PURPOSE CONVERTIBLE DEVICE AND APPLICATION OF USE

(76) Inventor: Andre Carrier, Jr., 47 Pleasant Valley Rd., Feeding Hills, MA (US) 01030

( * ) Notice: Subject to any disclaimer, the term of this patent is extended or adjusted under 35 U.S.C. 154(b) by 261 days.

(21) Appl. No.: 11/163,083

(22) Filed: Oct. 4, 2005

(51) Int. Cl.
*A45B 23/00* (2006.01)
*A45B 3/00* (2006.01)

(52) U.S. Cl. ..... 135/16; 135/77; 248/508; 248/523; 294/51; 294/53.5

(58) Field of Classification Search ..... 135/15.1, 135/16–17, 77, 84, 98; 248/507–508, 523, 248/530; 294/53.5, 54.5, 55, 51, 57, 59
See application file for complete search history.

(56) References Cited

U.S. PATENT DOCUMENTS 4,700,420 A * 10/1987 Belanger ..... 7/114
4,753,411 A 6/1988 Lechner et al.
4,850,564 A 7/1989 Padin
5,105,493 A * 4/1992 Lugtenaar ..... 7/116
5,122,014 A 6/1992 Genfan
5,271,196 A * 12/1993 Fanti ..... 52/166
5,293,889 A 3/1994 Hall et al.
5,457,918 A 10/1995 Plourde
5,482,071 A * 1/1996 Liu ..... 135/66
5,482,246 A 1/1996 Derkoski
5,524,855 A 6/1996 Lesar
D371,901 S 7/1996 Perls
5,799,996 A * 9/1998 Fredrickson ..... 294/51
5,906,077 A 5/1999 Andiarena
D421,532 S 3/2000 Koroncai
6,109,365 A * 8/2000 Lamoureux et al. ..... 173/90
6,164,613 A 12/2000 Williams
6,199,569 B1 3/2001 Gibson
6,354,554 B1 * 3/2002 Hollenbeck ..... 248/530
6,516,897 B2 2/2003 Thompson
6,715,503 B2 4/2004 Brooks, III
7,219,382 B2 * 5/2007 Johnson ..... 7/116

* cited by examiner

*Primary Examiner*—Winnie Yip
(74) *Attorney, Agent, or Firm*—Doherty, Wallace, Pillsbury & Murphy, PC

(57) ABSTRACT

A multi-purpose convertible device interchangeably convertible from a shovel mode to an anchor mode, wherein, when in the shovel mode, the convertible device removes earthen material to form an opening, and when in the anchor mode, the earthen material is positioned on a portion of the convertible device to weigh down the convertible device such that the convertible device resists displacement by typically encountered environmental conditions.

13 Claims, 5 Drawing Sheets

MULTI-PURPOSE CONVERTIBLE DEVICE AND APPLICATION OF USE

BACKGROUND OF THE INVENTION

1. Field of the Invention

This invention relates to a multi-purpose convertible device. More particularly, this invention relates to a device capable of transitioning between a shovel mode and an anchor mode and is useful in preparing the ground area in which the device is to be set, in driving the device into the ground, and in maintaining the device's position within the ground. The invention further relates to an exemplary application of the convertible device as an integrated outdoor umbrella assembly.

2. Background of the Invention

Signs, posts, outdoor umbrellas, and other items typically inserted into the ground for support provide specific problems in terms of positioning and stability. For example, an opening oftentimes needs to be first created to ease the positioning of the item. Accordingly, shovels are often employed to create the opening. Additionally, once the item is inserted into the opening, it is often difficult to maintain the position of the item when the item is exposed to its environmental conditions. That is, winds and precipitation often displace the item and may cause it to "fly away". Accordingly, what is needed is a single device capable of creating an opening and in anchoring the item to the ground. Such an item will eliminate the need to carry a separate digging device, such as a shovel, and will reduce the likelihood that the item will move from its position once anchored in the ground.

A particularly exemplary application of the present invention is in the area of outdoor umbrellas. A significant problem encountered in water sport activities and other sun-related activities is the problem of providing a place where participants may have temporary respite from the sun. For health and comfort reasons, it is often desirable to provide a shady retreat from the sun, wind screening, and the like, especially for all day activities that may be recreational or otherwise.

Installing a temporary sun screen, such as an umbrella, requires a support for the umbrella pole other shading device. Many people have discovered that the ground is seldom suitable to easily drive an umbrella pole into it to the depth required for supporting the umbrella during even light breezes. The difficulties encountered in supporting umbrella poles are quite significant as attested to by the fact that many patents are directed to solving this problem. In fact, persons who have gone to the beach, pool, or park with an umbrella are typically well aware of the problems involved in securely mounting an umbrella. Firmly affixing the umbrella pole in the ground, within a reasonable time, typically requires equipment designed for this purpose. Ground conditions may include dried dirt, grassy areas, sand, clay, gravel, moisture, and many other variations.

Therefore, various corkscrew devices, heavy metallic poles, hammers, and the like have been used to anchor the umbrella. Such devices, while for the most part effective, have significant drawbacks. For instance, carrying to the beach a twenty-pound metallic pole to make a hole in the sand is undesirable, especially since this will typically be carried along with many other items such as chairs, coolers, and the like. Hammers may be used to drive in umbrella poles, but eventually ruin the umbrella poles by creating unplanned stresses on components, such as connectors, not designed to be impacted.

Logistical problems arise. Regardless of the device selected, extra planning and care is needed to insure that the device actually reaches the destination where it can be used. If forgotten, of course, such devices are useless. Normally, many other items are also desirably carted to the destination so that logistics works strongly against reliable arrival of special anchors, digging tools and the like. Furthermore, even if one manages to remember to bring the special, and usually costly, device to the desired location, there remains the problem of remembering to take it back. Such devices are especially susceptible to being lost after use by neighbors who inevitably encounter the same problem. As well, due to the need to remove items in the dusk, after the eyes have become accustomed to bright light, the device may be left at the location due to oversight.

Consequently, there remains a need for an anchor assembly that operates to provide a firm anchor in various types of ground, that is lightweight, and that is so compact that it comprises part of the umbrella itself and requires no additional heavy, bulky parts to be carried with or lost at the location of desired use. Those skilled in the art have long sought and will appreciate the present invention that addresses these and other problems.

SUMMARY OF THE INVENTION

The above-discussed and other drawbacks and deficiencies of the prior art are overcome or alleviated by a multi-purpose convertible device interchangeably convertible from a shovel mode to an anchor mode, wherein, when in the shovel mode, the convertible device removes earthen material to form an opening, and when in the anchor mode, the earthen material is positioned on a portion of the convertible device to weigh down the convertible device such that the convertible device resists displacement by typically encountered environmental conditions.

DETAILED DESCRIPTION OF THE INVENTION

The multi-purpose convertible device of the present invention transitions between a shovel mode and an anchor mode, thereby allowing items, such as signs, posts, outdoor umbrellas, and any other item that is typically driven into the ground for support, to be readily inserted into the ground and maintained therein. The present convertible device will be more particularly described below with reference to an exemplary application in an outdoor umbrella assembly, where it is to be recognized that this application is exemplary only, and that the device may be utilized in a wide variety of items supported in the ground and which extend therefrom.

The outdoor umbrella assembly of the present invention comprises an outdoor umbrella device attachable to the multipurpose convertible device, wherein the convertible device transitions between a shovel mode and an anchor mode. The shovel mode assists a user in forming an opening by removing dirt, mud, grassy areas, sand, clay, gravel, rocks, mulch, and many other variations ("earthen material"), from the area in which it is desired to set the device. The anchor mode assists in setting the device in the opening, whereby the device resists displacement from its set position by environmental winds and precipitation to which the device is typically exposed when in use.

The outdoor umbrella device comprises a conventional canopy, such as is seen on beach umbrellas, patio umbrellas, and the like. The outdoor umbrella device further comprises a pole, which may be attached to the canopy in a conventional manner, such that, for example, the canopy can be extended (opened) and retracted (closed).

Accordingly, the outdoor umbrella assembly of the present invention provides shade and protection from the sun and resists displacement from its implanted position by the surrounding environmental conditions. Additionally, the convertible device of the outdoor umbrella assembly provides a multi-purpose shovel/anchor element, thereby easing the process of setting up and stabilizing the outdoor umbrella when the canopy of the outdoor umbrella is in either an open or closed position.

For a further understanding of the inventive features of the present invention, it shall be further described with reference to the figures. However, the following description of the invention is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

Figure 1:
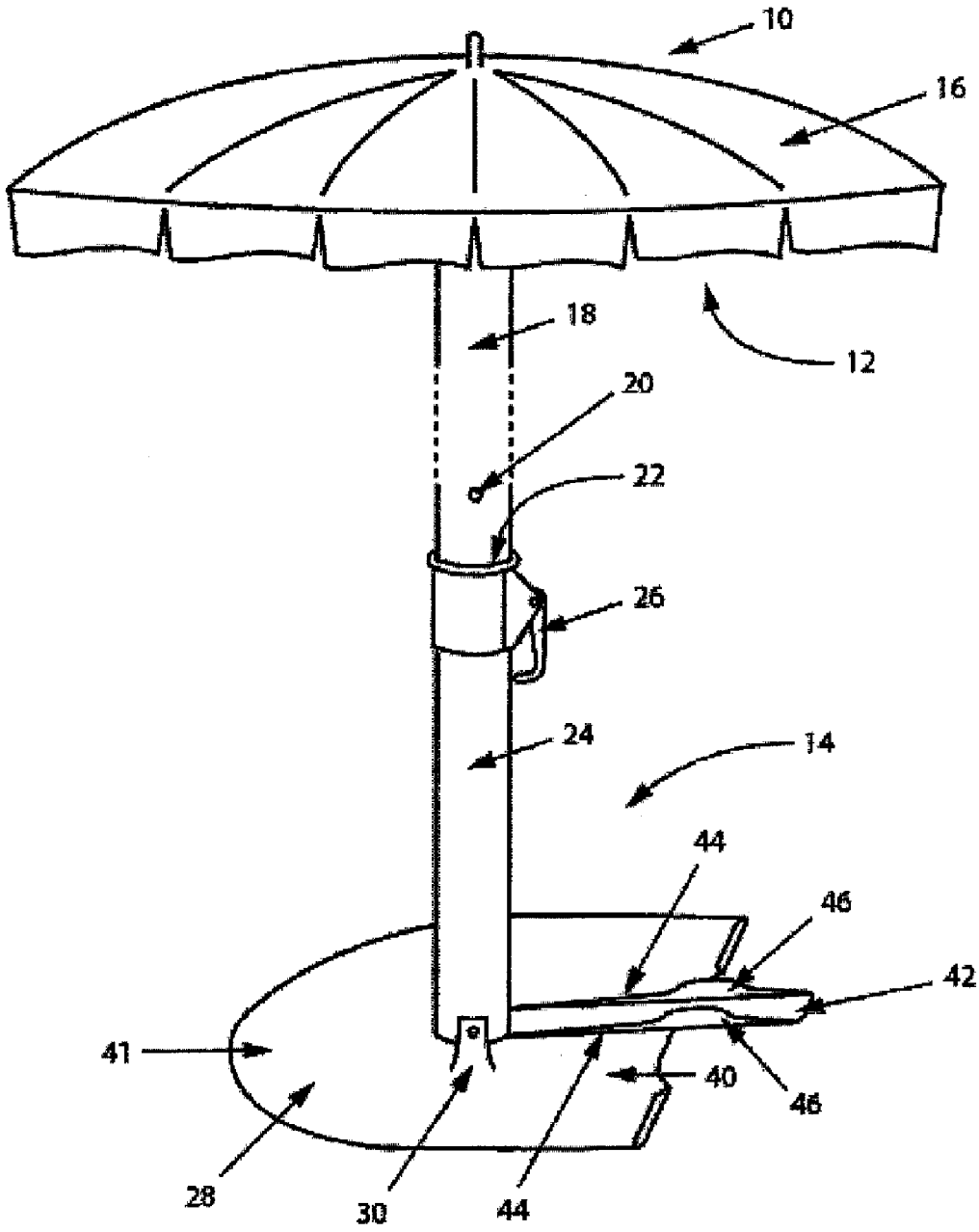
FIG. 1 is a schematic depicting a front view of an exemplary outdoor umbrella assembly of the present invention.

Referring to FIG. 1, an exemplary outdoor umbrella assembly 10 comprises an outdoor umbrella device 12 and a convertible device 14. Outdoor umbrella device 12 comprises a canopy 16 attached to a pole 18. Pole 18 comprises a canopy positioning element 20, as is conventionally known in the art, for opening and closing canopy 16.

Referring to FIGS. 1-5, convertible device 14 comprises an extension element 24 which receives a terminal end 22 of pole 18. Pole 18 is secured thereto by an umbrella mounting element 26. Umbrella mounting element 26 may comprise a wide variety of attachment mechanisms, wherein it is preferred that the attachment mechanism releasably receives pole 18, such that umbrella device 12 is detachable from convertible device 14. An exemplary umbrella mounting element 26 comprises, for example, a latch lock mechanism. Additionally, although FIG. 1 depicts pole 18 as fitted within extension element 24, it is contemplated that pole extension element 24, alternatively, may be fitted within pole 18 by a variety of attachment mechanisms.

Again referring to FIGS. 1-5, convertible device 14 further comprises a head 28, a mode transitioning element 30, and a receiver 32. Head 28 is attached to extension element 24 via mode transitioning element 30. Mode transitioning element 30 allows extension element 24 to move in an up and down motion such that head 28 functionally transitions from a shovel mode to an anchor mode. As shown more specifically in FIG. 3, an exemplary mode transitioning element 30 comprises a swivel screw mechanism, wherein a screw 34 is inserted through extension element 24 via holes 35 located on opposite sides of extension element 24 and via complementary a screw holes (not shown) located on a plate 38, wherein plate 38 is attached to extension element 24 and to head 28 by, for example, molding or welding. The tension of screw 34 is sufficient such that extension element 24 may be moved in an up and down direction with relative ease. Additionally, screw 34 may be tightened to temporarily lock extension element 24 with receiver 32, and loosened to assist in disengaging extension element 24 from receiver 32.

Although plate 38 is depicted as permanently attached to head 28, such as may be accomplished via welding, molding, and the like, attachment may be nonpermanent, such as may be achieved via screws, nails, and the like. Additionally, although mode transition element 30 comprises a swivel screw mechanism, it is contemplated that it may comprise a variety of mechanisms so long as the mechanism allows the receiver to pivotally move in an upward direction, i.e., in a direction away from receiver 24, and in a downward direction, i.e., in a direction towards receiver 24, such as is accomplished, for example, by a hinge mechanism.

Receiver 32 is connected to head 28 and extends towards a base region 40 of head 28, wherein base region 40 is opposite to a forward facing region 41 of head 28. Receiver 32 is configured such that extension element 24 rests or is otherwise held by receiver when head 28 is in a shovel mode. In an exemplary embodiment receiver 32 is welded, molded, screwed or otherwise secured to head 28.

Receiver 32 comprises a holding chamber 42 which may extend along the entire length of receiver 32. Additionally, receiver 32 is defined by two longitudinally extending side walls 44 which step up at the distal end of receiver 32 to form tabs 46. Tabs 46 provide a leverage means whereby extension element 24 is more securely held to receiver 32. That is tabs 46 serve to cradle or hug extension element 24 into position. It is further noted that receiver 32 may comprise additional or alternative means for securing extension element 24 thereto, wherein the only limitation placed upon the receiver is that it be able to securely hold the extension element when the convertible device is in a shovel mode and that it not obstruct the other components of the outdoor umbrella assembly. Additionally, receiver 32 should allow for the relatively easy release of extension element 24 when it is desired to transition the convertible device into the anchor mode. Accordingly, the receiver temporarily locks the extension element into place while the convertible device is in the shovel mode, and disengages the extension element when the convertible device is in the anchor mode. Although it is contemplated that receiver 32 in and or itself may adequately secure extension element 24 with receiver 32, for further securement of extension element 24 into receiver 32, screw 34 may be tightened. Consequently, in this embodiment, to release extension element 24 from receiver 32, screw 34 may be loosened.

Figure 2:
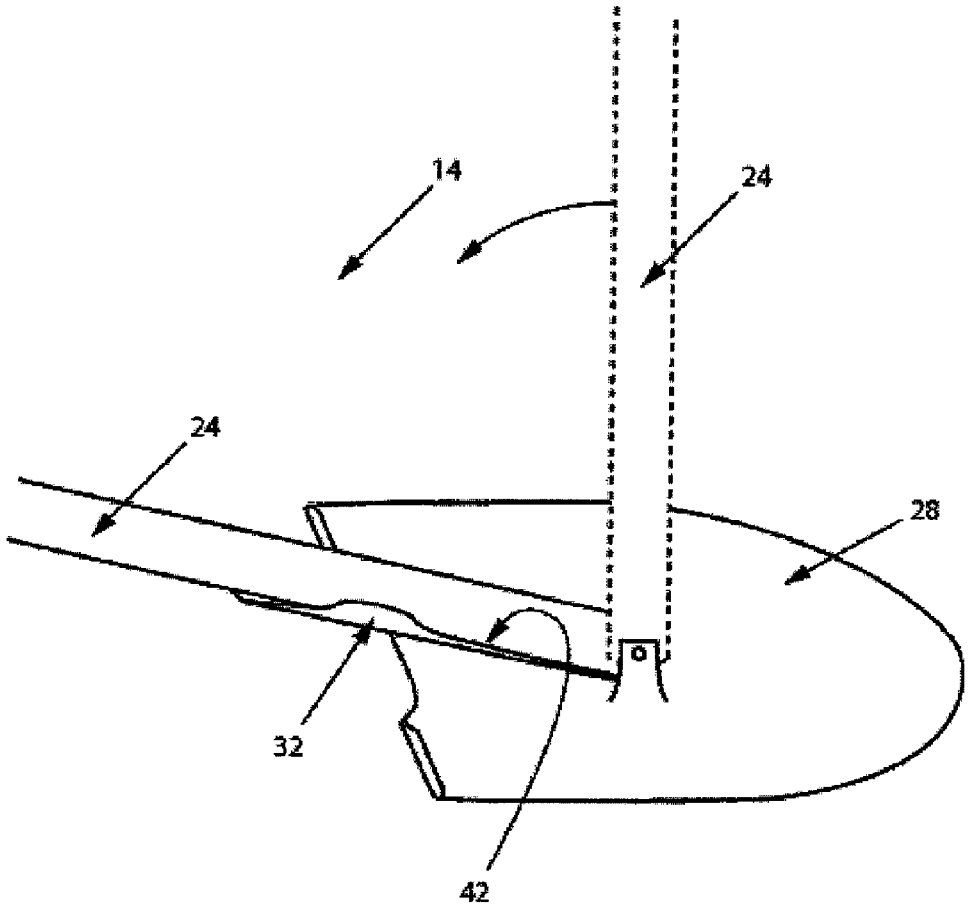
FIG. 2 is a schematic depicting a lateral side of an exemplary convertible device of the present invention, wherein the convertible device is in an exemplary shovel mode.
Figure 3:
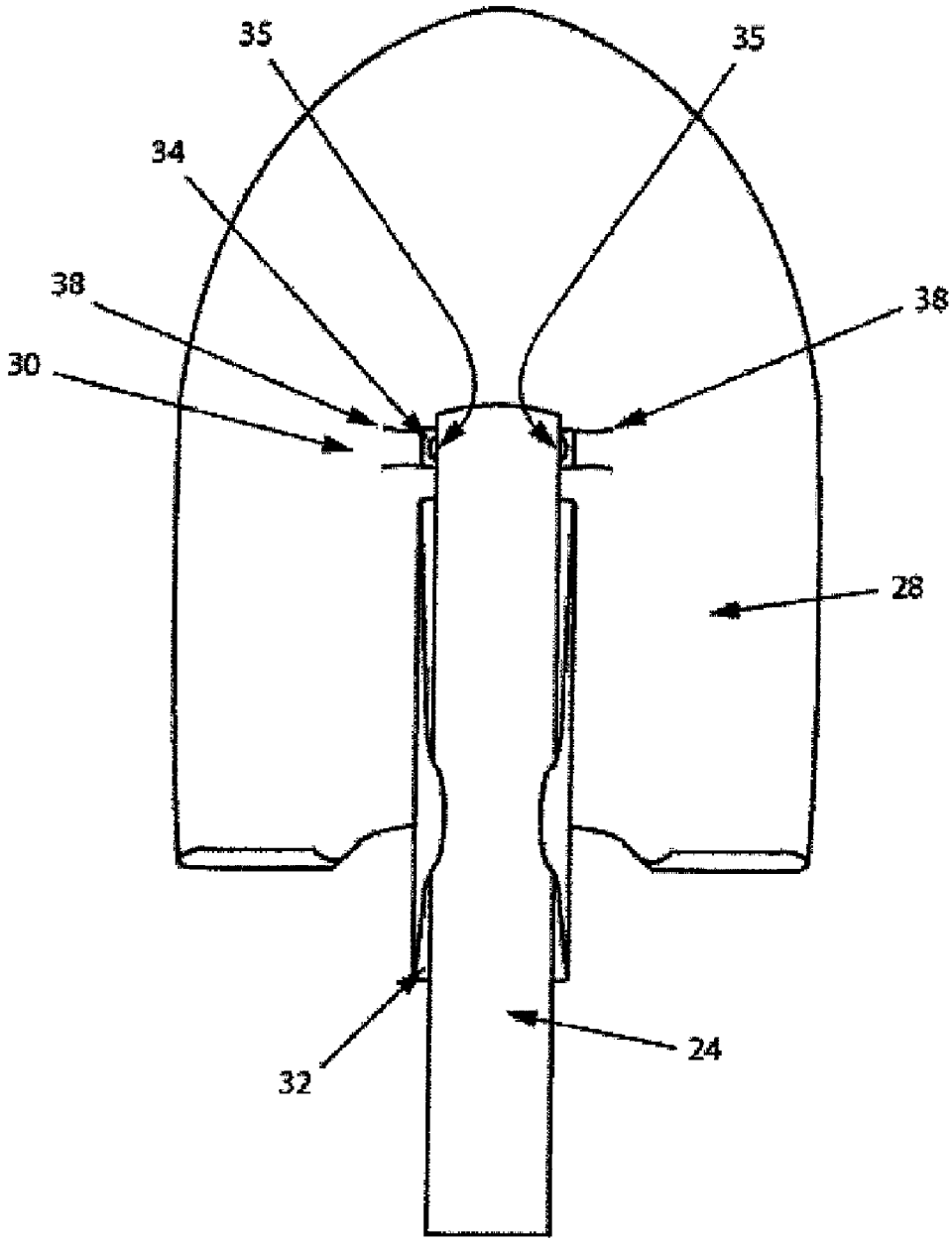
FIG. 3 is a schematic depicting a top side of an exemplary convertible device, wherein the convertible device is in a shovel mode.
Figure 4:
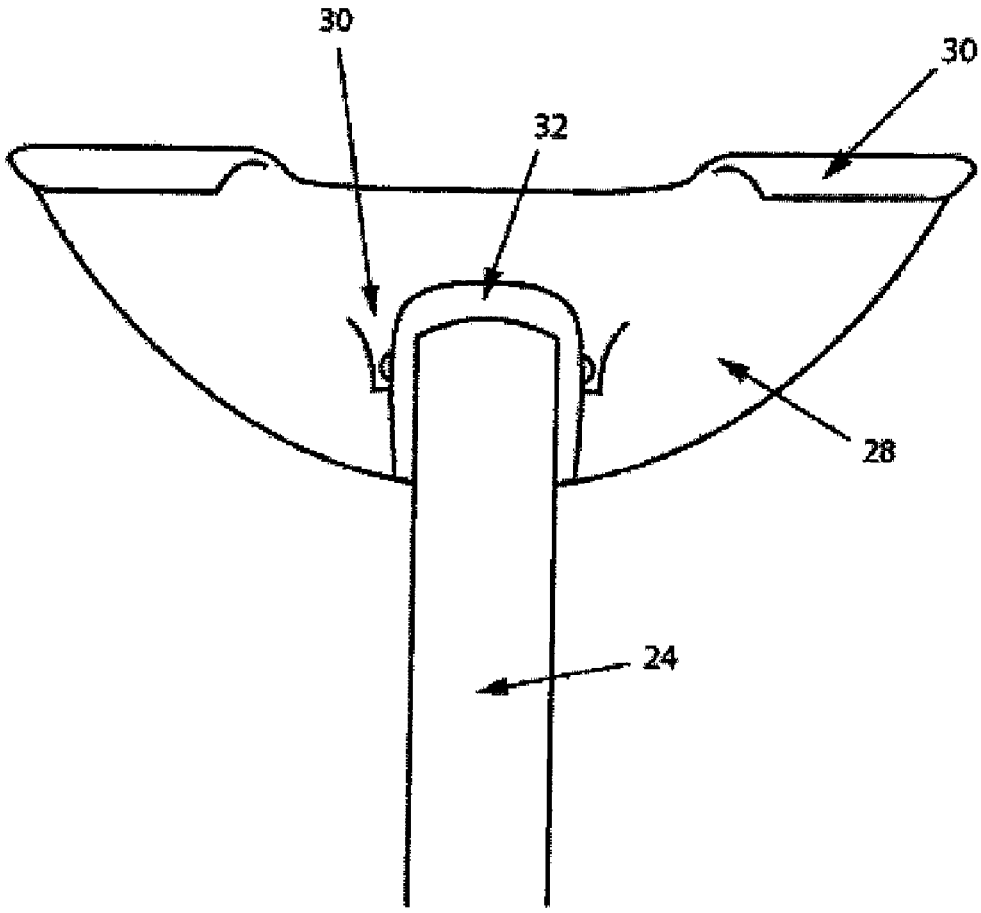
FIG. 4 is a schematic depicting an elevational view of a back side of an exemplary convertible device, wherein the convertible device is in an anchor mode.

An exemplary application of the present invention is now described with reference to FIGS. 1, 2 and 5. Referring to FIGS. 1 and 2, once the desired location for setting up the outdoor umbrella assembly is selected, combination convertible device 14 is positioned into the shovel mode so that the directly underlying earth may be removed to form an opening. Either before or after this time, outdoor umbrella device 12 is released and removed from convertible device 14. To achieve the shovel mode, extension element 24 is moved in a downward direction (as shown by the arrow) towards receiver 32 until extension element 24 is securely positioned onto holding chamber 42, and locked to receiver 32, for example, by tightening screw 34. While utilizing extension element 24 as a handle and head 24 as a digger, a user may remove earthen material from the desired location to form an appropriately sized opening.

Figure 5:
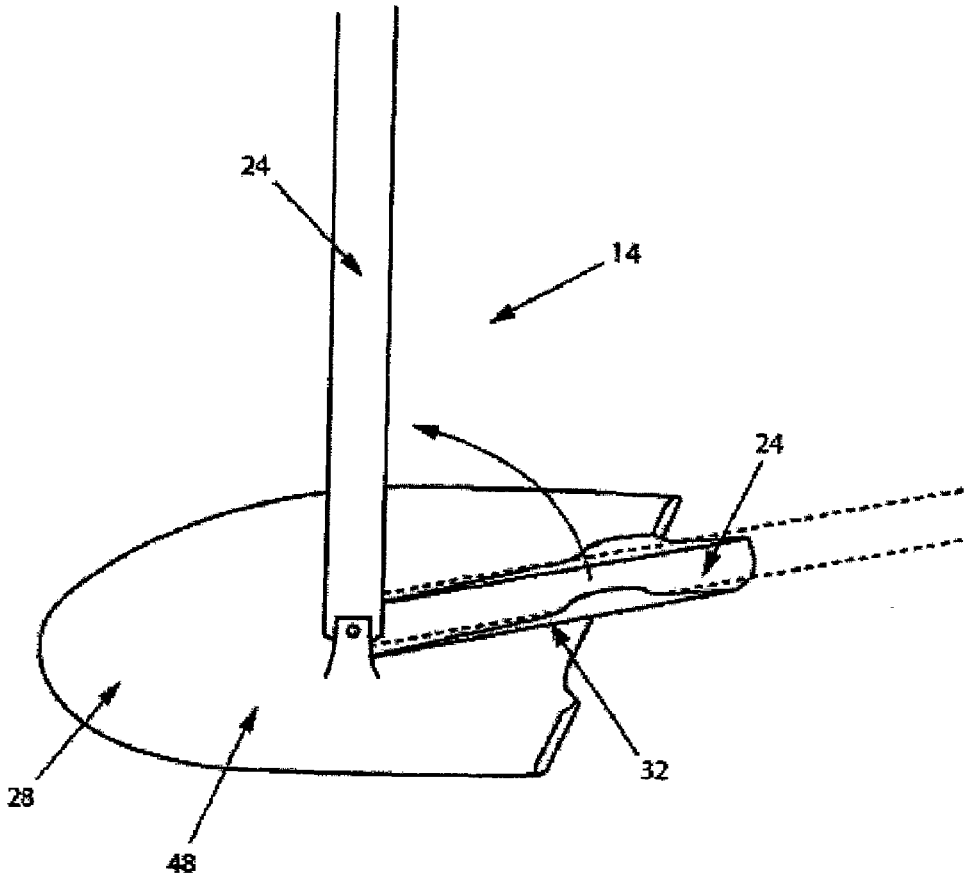
FIG. 5 is a schematic depicting a top side of an exemplary convertible device, wherein the convertible device is in an anchor mode.

Referring to FIG. 5, after the opening has been formed, extension element 24 is released from receiver 32 and moved in an upward direction (as shown by the arrow) to an upright position, wherein extension element is preferably approximately perpendicular to a top surface 48 of head 28. Once in this anchor mode, a portion of convertible device 14 including head 28 is placed into the opening. The dug up earthen material is then placed over the opening to cover at least head 28. In this manner, then, the earthen material weighs the outdoor umbrella assembly down to the ground, thereby, reducing the likelihood that the device will uplift or "fly away" when exposed to typically encountered winds and/or precipitation, and, thereby, improving the wind and/or precipitation resistance of the device as compared to conventional outdoor umbrellas. Before or after convertible device 14 is placed and secured in the opening, outdoor umbrella device 12 may be reattached to convertible device by attaching pole 18 to extension element 24 as discussed above.

Accordingly, as understood by the present disclosure, the present invention provides a unique and non-obvious multipurpose convertible device capable of being integrated with a conventional outdoor umbrella, and with a wide range of other items supported in the ground. The convertible device is easily transitioned between a shovel mode and an anchor mode. In the shovel mode, earthen material, for example, may be conveniently and easily removed to form an opening. And in the anchor mode, which provides a means whereby the earthen material may be placed atop and around the head of the convertible device to weigh the convertible device and attached outdoor umbrella to the ground, the likelihood of displacement of the outdoor umbrella assembly is when exposed to typical wind conditions and/or typical precipitation is greatly reduced as compared to the displacement that would occur with conventional outdoor umbrellas exposed to the same environmental conditions.

What is claimed is:

1. An outdoor umbrella assembly comprising:

an outdoor umbrella device attachable to a convertible device, wherein:

the convertible device is interchangeably convertible from a shovel mode to an anchor mode, wherein, when in the shovel mode, the convertible device removes earthen material to form an opening, and when in the anchor mode, the earthen material is positioned on a portion of the convertible device to weigh down the convertible device, and wherein:

the outdoor umbrella device comprises a canopy and a pole; and the convertible device comprises:

a head;

an extension element pivotally attached to the head, wherein the pole of the outdoor umbrella device attaches the canopy to the extension element; and a receiver mounted to the head, wherein the receiver receives and holds the extension element when the convertible device is in the shovel mode.

2. The outdoor umbrella assembly of claim 1, wherein the convertible device further comprises a mode transitioning element that pivotally attaches the extension element to the head.

3. The outdoor umbrella assembly of claim 1, wherein the convertible device further comprises an umbrella mounting element attached to the extension element, wherein the umbrella mounting element releasably secures the outdoor umbrella device to the extension element.

4. The outdoor umbrella assembly of claim 1, wherein the outdoor umbrella device is removably attachable to the convertible device.

5. The outdoor umbrella assembly of claim 1, wherein, when the convertible device is in the anchor mode, the extension element is approximately perpendicular to a top surface of the head.

6. An outdoor umbrella assembly comprising:

an umbrella device comprising a canopy positioned over a pole; and a convertible device interchangeably converted from a shovel mode to an anchor mode, wherein the convertible device comprises:

a head;

an extension element pivotally attached to the head, and which receives and holds the pole of the umbrella device;

a receiver disposed on the head, and fixed into position thereon, wherein the receiver receives and holds the extension element when the convertible device is in the shovel mode; and a mode transitioning element having a first portion disposed on the head, and a second portion mounted to the extension element, wherein the mode transitioning element connects the extension element to the head while allowing the extension element to pivotally move in relation to the head.

7. The outdoor umbrella assembly of claim 6, wherein the mode transitioning element comprises a first plate and a second plate, wherein each of the first and second plates comprises a first end opposite to a second end, wherein the first end is disposed on the head, and the second end is mounted to an outer surface of the extension element.

8. The outdoor umbrella assembly of claim 7, wherein the head comprises a body having a top surface opposite to a bottom surface, and wherein the receiver is permanently disposed on the top surface of the head.

9. The outdoor umbrella assembly of claim 8, wherein the receiver is welded or molded onto the top surface of the head.

10. The outdoor umbrella assembly of claim 6, wherein the head further comprises a body having a top surface opposite to a bottom surface, and defined at its terminal ends by a forward facing region opposite to a base region, and wherein the receiver extends along a portion of a length of the top surface past the base region, and further wherein the receiver comprises two longitudinally extending side walls which border a recessed holding chamber having a surface disposed between the two longitudinally extending side walls, wherein the extension element rests on the surface of the recessed holding chamber when the assembly is in a shovel mode and is held thereto by the side walls.

11. The outdoor umbrella assembly of claim 10, wherein the receiver is permanently disposed on the top surface of the head.

12. The outdoor umbrella assembly of claim 11, wherein the receiver is welded or molded onto the top surface of the head.

13. The outdoor umbrella assembly of claim 10, wherein the mode transitioning element comprises a first plate and a second plate, wherein each of the first and second plates comprises a first end opposite to a second end, wherein the first end is disposed on the head, and the second end is mounted to an outer surface of the extension element.

* * * * *